United States Patent [19]

McCoy

[11] 4,039,462

[45] Aug. 2, 1977

[54] SYNTHETIC POLYESTER-BASED LUBRICANTS POSSESSING A WIDE RANGE OF DESIRABLE PHYSICAL CHARACTERISTICS INCLUDING SOLUBILITY IN MINERAL OIL

[75] Inventor: Frederic C. McCoy, Beacon, N.Y.

[73] Assignee: Texaco Inc., New York, N.Y.

[21] Appl. No.: 637,426

[22] Filed: Dec. 3, 1975

Related U.S. Application Data

[63] Continuation-in-part of Ser. No. 570,285, April 21, 1975.

[51] Int. Cl.[2] ..... C10M 1/32

[52] U.S. Cl. ..... 252/51.5 A; 252/51.5 R; 252/56 S; 260/404

[58] Field of Search ..... 252/51.5 A, 51.5 R, 252/565 S; 260/404

[56] References Cited

U.S. PATENT DOCUMENTS

| | | | |
|---|---|---|---|
| 3,000,917 | 9/1961 | Babayan | 252/56 S X |
| 3,048,623 | 8/1962 | Matuszak et al. | 252/56 X |
| 3,251,852 | 5/1966 | De Groote et al. | 252/51.5 R X |
| 3,398,163 | 8/1968 | Meyers et al. | 260/404 |
| 3,456,013 | 7/1969 | Egan et al. | 252/51.5 R X |
| 3,794,586 | 2/1974 | Kimura et al. | 252/51.5 R |
| 3,806,456 | 4/1974 | Vogel | 252/51.5 A |
| 3,842,106 | 10/1974 | Onopchenko et al. | 252/51.5 A X |

*Primary Examiner*—Delbert E. Gantz
*Assistant Examiner*—Andrew H. Metz
*Attorney, Agent, or Firm*—Thomas H. Whaley; Carl G. Ries; Bernard Marlowe

[57] ABSTRACT

This invention concerns polyester-based synthetic lubricants having a wide range of desirable lubricating properties prepared by condensing specific ratios of alkoxylated primary alkylmonoamines, monobasic alkanoic and dibasic alkanoic acids.

15 Claims, No Drawings

SYNTHETIC POLYESTER-BASED LUBRICANTS POSSESSING A WIDE RANGE OF DESIRABLE PHYSICAL CHARACTERISTICS INCLUDING SOLUBILITY IN MINERAL OIL

This invention is a continuation-in-part of Ser. No. 570,285 filed in the U.S. Pat. Office on Apr. 21, 1975.

SUMMARY OF THE INVENTION

This invention concerns the preparation of novel polyester-based synthetic lubricants having a wide range of physical characteristics and mineral oil solubility.

More particularly, this invention relates to polyester-based lubricating products prepared by condensing three classes of reactants:

1. alkoxylated primary alkylmonoamines,
2. monobasic alkanoic acids, and
3. dibasic alkanoic acids in specific molar ratios.

The products of this invention have utility as lubricants and/or lubricating additives that are soluble in mineral oil enabling the alteration of viscosity, pour point and viscosity index of the mineral oil used as the blending stock.

BACKGROUND OF THE INVENTION

In the parent application, Ser. No. 570,285 synthetic lubricants are prepared by reacting one mole of alkoxylated primary alkylmonoamine having terminal OH groups with two moles of monobasic alkanoic acids. A diester of relatively low molecular weight (and low viscosity) is obtained which has limited value as a synthetic lubricant particularly for blending with mineral oils to modify and upgrade their properties. On the other hand, if the same quantities of the same alkoxylated primary alkylamine is reacted with a mole of a dibasic alkanoic acid a product having a very high molecular weight and possessing very high viscosity can be prepared. These latter products can also be useful as lubricant blending agents and/or as additives with mineral oil. However, the products having only very high or low viscosities are more limited in their applications than they need be if products with a wider range of viscosity were available.

In order to more precisely disclose the invention, its scope and application, in the greatest possible detail, a supplemental discussion of the invention follows. Unless otherwise disclosed, all parts are by weight, all degrees are in centigrade and all tests for determining viscosity, viscosity index, neutralization number and total base number are essentially ASTM procedures.

I. Synthetic Procedure for Esterifying the Alkoxylated Primary Alkylmonoamines.

These amines are one of the three classes of reactants used to prepare the lubricant products of this invention and are set forth below using the proportions of the reactants shown:

A mole of one or more primary alkylamines previously alkoxylated with at least two mols of ethylene oxide, propylene oxide and/or mixtures of the two alkylene oxides are added to a reactor fitted with heating, cooling and agitating means, and a Dean-Stark Trap. A substantial quantity of inert solvent capable of forming azeotropic mixtures with water at temperatures above about 120° C is added to the reactor and the solution is stirred vigorously with from 0.05 to 0.95 moles of dibasic alkanoic acid and 1.85 to 0.05 moles of monobasic alkanoic acid. By a substantial quantity of inert solvent is meant a volume ratio of reaction mixture to inert solvent of about 2:1 when alkylated aromatics such as toluene, xylene, mesitylene and the like are used. The same ratio holds true when other azeotroping soluents, well known in the art, are used, such as, for example, heptane and octane. Esterification catalysts such as p-toluene sulfonic acid, and oxidation inhibitors such as the trialkyl or triaryl phosphites or alkylated diphenylamines may be used if desired. Also about a 10–20% molar excess of the alkoxylated amine may be employed if desired to achieve a product of minimum neutralization number. The reactor is heated to reflux temperatures with stirring until all the water of reaction (condensation) is removed. This usually requires between about 4 to 8 hours total reaction temperature time, usually about 6 hours total reaction time, and a final temperature of about 200°–230° C. The reaction mixture is cooled to room temperatures and about an equal volume of low-boiling hydrocarbon solvent such as pentane added. The cooled solution is percolated through a column of finely granulated decolorizing solid such as an attapulgite clay or activated alumina. If desired, before decolorizing, the filtrate may be contacted with an aqueous solution of a mild inorganic base such as sodium bicarbonate and dried over a drying agent such as $Na_2SO_4$. In any case, the solvent is finally stripped out under vacuum.

II. Suitable Reactants for Preparing Desired Diesters.

A. Alkoxylated Amines:

These reactants include primary alkylamines containing from 4 to 30 carbon atoms which have been reacted with about 2 to 50 moles of an alkylene oxide such as ethylene oxide, propylene oxide, butylene oxide or mixtues of these alkylene oxides. The alkyl group of the amine may be primary, secondary or tertiary. A favored starting material is a mixture of secondary alkyl primary amines containing from 7 to 15 carbon atoms, which have been reacted with about 2 moles of ethylene oxide. The most preferred amines are the beta amines containing 10 to 14 carbon atoms prepared according to U.S. Pat. No. 3,470,252.

B. Monobasic Alkanoic Acids:

Saturated aliphatic or cycloalkphatic monobasic acids containing about 1 to 30 carbon atoms, preferably from 6 to 12 carbon atoms are employed. Specific acids or their mixtures may be used. The following monobasic acids are illustrative: formic, acetic, propionic, butyric, isobutyric, valeric, caproic, heptanoic, caprylic, capric, lauric and the various isomeric branched chain aliphatic acids of similar molecular weight. Naphthanic acids of corresponding molecular weight may also be used.

C. Dibasic Alkanoic Acids:

Dibasic acids containing from 2 to 12 carbon atoms can be used either in the form of specific acids or as mixtures of these acids. The following are illustrative of the dibasic acids which can be employed: oxalic, malonic, maleic, succinic, citraconic, itaconic, glutaric, adipic, azelaic, pimelic, sebacic, suberic and decane dicarboxylic. The preferred acid is azelaic.

D. Data on Utility of Representative Polyesters:

In the Table which follows, the examples below, it will be seen that 3 characeristics:

1. Viscosity at 210° F, c.s. ranging from about 5–575 c.s.
2. Viscosity index from 120–200, 3. Pour Point, ° F. +15° to −65° F are especially useful properties of lubricants per se, or as a means of obtaining desirable modifications through blending with mineral oils.

EXAMPLE 1

PREPARATION OF ILLUSTRATIVE POLYESTER-BASED LUBRICANT USING AN ETHOXYLATED PRIMARY AMINE, A SPECIFIC MONOBASIC ALKANOIC ACID AND A SPECIFIC DIBASIC ALKANOIC ACID AS REACTANTS

Two moles of an ethoxylated secondary alkyl primary amine containing an average of about 2 moles of ethylene oxide per mole and containing 15 carbon atoms exclusive of ethylene oxide are charged to the type of a reactor described previously, along with 300 ml of xylene, and the reactor fitted with heating, stirring means, a condenser and a Dean Stark Trap. To this stirred mixture are added 2 moles pelargonic (n-nononoic) acid, 1 mole of azelaic acid and 3 g of p-toluene sulfonic acid as an esterification catalyst. The reaction mixture is stirred and heated to reflux and the water from the condensation reaction is removed. The pot temperature is gradually increased by removing the xylene at about 230° C and holding at this temperature until the water is stripped off. After about 6 hours total reaction time the reaction mixture is cooled to 22° C and an equal volume of pentane is added to the cooled mixture. The mixture is filtered through a column containing 500 g attapulgite clay (20–40 mesh) and the effluent is stripped of solvent at 100° C under 15 mm of vacuum. The physical characteristics of this and other condensates are given in the Table infra.

EXAMPLE 1*a* to 1*g*

In these Examples the procedure of Example 1 is followed except that the monobasic alkanoic acid (n-nonanoic acid) is replaced on a mole per mole basis with the monobasic acids as shown below:

| EXAMPLE | MONOBASIC ALKANOIC ACID | NO. OF CARBON ATOMS |
|---|---|---|
| 1a) | Caproic acid | 6 |
| 1b) | Heptanoic acid | 7 |
| 1c) | Capric acid | 10 |
| 1d) | Undecanoic acid | 11 |
| 1e) | Lauric acid | 12 |
| 1f) | Tridecanoic acid | 13 |
| 1g) | Stearic acid | 18 |

In all instances the polyester-based products obtained were found to have viscosity indexes and pour points suitable for lubricant use.

EXAMPLE 1*h* TO 1*k*

In these examples, the procedure of Example 1 is followed except that the dibasic acid (azelaic acid) employed with pelargonic acid and the specified ethoxylated amine is replaced on a mole per mole basis with the dibasic acids shown below:

| EXAMPLE | DIBASIC ACID | NO. OF CARBON ATOMS |
|---|---|---|
| 1h) | Glutaric | 5 |
| 1i) | Pimelic | 7 |
| 1j) | Suberic | 10 |
| 1k) | Decane dicarboxylic | 12 |

Again, qualitative screening of the polyester-based lubricants for luricant applications indicated useful products are formed.

EXAMPLES I*l* TO 1*o*

In these examples the procedure of Example 1 is followed in all respects except that the alkoxylated secondary (15 carbon primary amine employed contains propoxy, butoxy or mixtures of ethoxyl and propoxy groups.

| EXAMPLE | NATURE OF ALKOXY GROUPS IN $C_{15}$ AMINE ALKOXYLATE | AVERAGE NO. ALKOXYLATE GROUPS |
|---|---|---|
| 1l) | Propoxy | 2 |
| 1m) | Ethoxy | 8 |
| 1n) | Mixed ethoxy and propoxy | 4-ethylene oxide groups 2-propylene oxide |
| 1o) | Butoxy | 3 |

Once more preliminary screening of the polyester-based lubricants for lubricant application indicated useful products are formed.

EXAMPLES 2 TO 11

Preparation of other preferred polyester-based lubricants and their characteristics are shown in the Table which follows.

TABLE

| ETHOXYLATE | EXAMPLE 1 | EXAMPLE 2 | EXAMPLE 3 | EXAMPLE 4 | EXAMPLE 5 | EXAMPLE 6 |
|---|---|---|---|---|---|---|
| Parent Amine | $C_{15}$ Sec. Alkyl | $C_{11}$ Sec. Alkyl | $C_{11}$ Sec. Alkyl | $C_{11}$ Sec. Alkyl | $C_{11}$ Sec. Alkyl | $C_{10-14}$ Sec. Alkyl |
| Av. No. of Ethoxy Groups | 2 | 2 | 2 | 2 | 2 | 2 |
| MONOBASIC CID | PELARGONIC | PELARGONIC (n-Nonanoic) | PELARGONIC | CAPRYLIC (n-Octanoic) | PELARGONIC | PELARGONIC |
| DIBASIC ACID | AZELAIC | AZELAIC | AZELAIC | AZELAIC | SEBACIC | AZELAIC |
| MOLAR RATIOS Ethox./Monobasic Acid/Dibasic acid | 2/2/1 | 4/6/1 | 2.4/2/1 | 2.4/2/1 | 2.4/2/1 | 2.4/2/1 |
| OXIDATION INHIBITOR | NONE | NONE | TRIETHYL PHOSPHITE (TEP) | TEP | TEP | TEP |
| PERCOLATION MEDIUM | ATTAPULGITE CLAY | ATT. CLAY | ATT. CLAY | ATT. CLAY | ATT. CLAY | ACTIV. $Al_2O_3$ |

TABLE-continued

| CHARACTERISTICS OF PRODUCTS TESTED | | | | | | |
|---|---|---|---|---|---|---|
| Vis. at 100° F, cs. | 70.6 | 37.2 | 115.0 | 113.3 | 129.0 | 100.7 |
| 210° F, cs. | 12.44 | 7.25 | 17.17 | 17.25 | 18.85 | 15.61 |
| 0° F, cp. | 2600 | 1050 | 4250 | 4375 | 5000 | 3750 |
| Vis. Index | 188 | 176 | 174 | 178 | 175 | 175 |
| Pour Point, F | −60 | −45 | −45 | −55 | −40 | −65 |
| Total Base No. | — | 11.2 | 39 | 40 | 37 | 35 |
| Rust Rating (1) | — | 8.2 | 8.0 | 7.1 | 8.1 | 8.0 |
| Mineral Oil Misc. | Miscible | Miscible | Miscible | Miscible | Miscible | Miscible |
| Color, ASTM (2) | 5.5 | — | 1.0 | — | — | — |

(1) Rating of 10 is Rust-free, Mineral Oil gives rating of 3–4.
(2) 7 ml oil + 50 ml toluene

| ETHOXYLATE | EXAMPLE 7 | EXAMPLE 8 | EXAMPLE 9 | EXAMPLE 10 | EXAMPLE 11 (CONTROL) |
|---|---|---|---|---|---|
| Parent Amine | $C_{11}$ Sec. Alkyl | $C_{12}$ Primary Alkyl | $C_{11}$ Sec. Alkyl | $C_{12}$ Primary Alkyl | $C_{11}$ Sec. Alkyl. |
| Av. No. of Ethoxy Groups | 2 | 2 | 2 | 15 | 2 |
| MONOBASIC ACID | PELARGONIC | PELARGONIC | PELARGONIC | PELARGONIC | NONE |
| DIBASIC ACID | AZELAIC | AZELAIC | AZELAIC | AZELAIC | AZELAIC |
| MOLAR RATIOS | | | | | |
| Ethox./Monobasic Acid/Dibacis Acid | 2.4/2/1 | 2.4/2/1 | 2.4/2/1 | 2.4/2/1 | 1.0/1.0 |
| OXIDATION INHIBITOR | TEP | TEP | TRIPHENYL PHOSPHITE | TEP | NONE |
| PERCOLATION MEDIUM | $Al_2O_3$ | ATT. CLAY | ATT. CLAY | ATT. CLAY | NONE |
| CHARACTERISTICS OF PRODUCTS TESTED | | | | | |
| Vis. at 100° F, cs. | 110.9 | 63.5 | 100.2 | 183.3 | 9500 |
| 210° F, cs. | 16.75 | 11.74 | 15.16 | 29.52 | 574 |
| 0° F, cp. | 4060 | 1610 | — | — | — |
| Vis. Index | 175 | 195 | 170 | 238 | 120 |
| Pour Point, ° F | −45 | −15 | −45 | −15 | +15 |
| Total Base No. | — | — | — | — | — |
| Rust Rating | — | — | — | — | — |
| Mineral Oil Misc. | Miscible | Miscible | Miscible | Immiscible | Hazy Blend |
| Color, ASTM (1) | —149 | 1.0 | — | — | — |

| ETHOXYLATE | EXAMPLE 12 | EXAMPLE 13 | EXAMPLE 14 | EXAMPLE 15 | EXAMPLE 16 | EXAMPLE 17 |
|---|---|---|---|---|---|---|
| Parent Amine | $C_{11}$ Sec. Alkyl | $C_{11}$ Sec. Alkyl | $C_{11}$ Sec. Alkyl | $C_{11}$ Sec. Alkyl | $C_{11}$ Sec. Alkyl | $C_{11}$ Sec. Alkyl |
| Av. No. of Ethoxy Groups | 2 | 2 | 2 | 2 | 2 | 2 |
| MONOBASIC CID | PELARGONIC 54 | PELARGONIC | PELARGONIC | PELAR- | PELARGONIC | PELARGONIC |
| DIBASIC ACID | ADIPIC | AZELAIC | SUCCINIC | AZELAIC | AZELAIC | AZELAIC |
| MOLAR RATIOS | | | | | | |
| Ethox./Monobasic Acid/Dibasic Acid | 2.4/2/1 | 2.4/2/1 | 2.4/2/1 | 1.6/0.66/1 | 1.4/0.3/1 | 1.0/1.45/ 0.11 |
| OXIDATION INHIBITOR | TEP | ALKYL DIPHENYL-AMINES | ALKYL DIPHENYL-AMINES | DIPHENYL-AMINE | DIPHENYL-AMINE | TEP |
| PERCOLATION MEDIUM | Activ. $Al_2O_3$ | Activ. $Al_2O_3$ | Activ. $Al_2O_3$ | Active. $Al_2O_3$ | Active. $Al_2O_3$ | Activ. $Al_2O_3$ |
| CHARACTERISTICS OF PRODUCTS TESTED | | | | | | |
| Vis. at 100° F, cs. | 104.9 | 122.2 | 96.2 | 618.5 | 1945 | 28.36 |
| 210° F, cs. | 15.40 | 17.31 | 13.38 | 60.8 | 159.2 | 5.85 |
| 0° , Cp. | 4060 | 5160 | 5000 | — | — | 602 |
| Vis. Index | 165 | 166 | 150 | 175 | 128 | 170 |
| Pour Point, ° F | −65 | −55 | −55 | −40 | −20 | −50 |
| Total Base No. | 70 | — | — | — | — | — |
| Rust Rating | 8.0 | — | — | — | — | — |
| Mineral Oil Misc. | Miscible | Miscible | Miscible | Miscible | Miscible | Miscible |
| Color ASTM (1) | — | — | 3.0 | 5.5 | — | — |

(1) 7 ml oil + 50 ml toluene.

As the numerous examples clearly document, the products of this invention offer a wide range of useful properties when used as lubricants per se or blended with mineral oil.

Insofar as is known, these compounds have not been prepared or disclosed for any purpose whatsoever, much less known to possess the useful properties which permit their use as synthetic lubricating oils or as additives when blended with mineral oils.

While numerous modifications, changes and substitutions can be made without departing from the inventive concept, the metes and bounds of this invention can best be seen from a perusal of the claims which follow, taken in conjunction with the rest of the specification.

What is claimed is:

1. Synthetic polyester-based lubricant products prepared by the reaction of three classes of reactants in the presence of esterification catalyst and inert solvent capable of forming binary azeotropes with the water formed at the reaction temperatures, by:

A. Forming a reaction mixture of a. alkoxylated primary alkylmonoamine reactant containing 4 to 30 carbon atoms and an average of 2 to 50 alkoxy groups, b. monobasic alkanoic acid reactant containing from 1 to 30 carbon atoms, c. dibasic alkanoic acids containing from 2 to 12 carbon atoms, said reactants being present in the proportions, that for each mole of (a) present, from 1.85 to 0.05 moles of (b) and from 0.5 to 0.95 moles of (c) as well as:

d. a catalytic quantity of esterification catalyst, and e. a substantial quantity of said inert solvent capable of forming binary azeotropes with the water formed at the reaction temperatures.

B. Heating said reaction mixture to reflux temperatures for a time sufficient to prepare said lubricant products and removing the water of reaction formed as said inert solvent-water binary azeotrope.

2. The lubricant product of claim 1 wherein the alkoxylated primary alkylmonoamine is a secondary alkylamine containing 15 carbon atoms and an average of 2 ehtylene oxide groups in the molecule, the monobasic alkanoic acid is n-nonanoic acid, the dibasic alkanoic acid is azelaic acid and the molar ratio of alkoxylated amine to monobasic alkanoic acid to dibasic alkanoic acid is 2/2/1.

3. The lubricant product of claim 1 wherein the alkoxylated primary alkylmonoamine is a secondary alkylamine containing 11 carbon atoms and an average of 2 ethylene oxide groups in the molecule, the monobasic alkanoic acid is n-nonanoic acid, the dibasic alkanoic acid is azelaic acid and the molar ratio of alkoxylated amine to monobasic alkanoic acid to dibasic alkanoic acid is 4/6/1.

4. The lubricant product of claim 1 wherein the alkoxylated primary alkylmonoamine is a secondary alkylamine containing 11 carbon atoms and an average of 2 ethylene oxide groups in the molecule, the monobasic alkanoic acid is n-nonanoic acid, the dibasic alkanoic acid is azelaic acid and the molar ratio of the alkoxylated amine to monobasic alkanoic acid to dibasic alkanoic acid is 2.4/2/1.

5. The lubricant product of claim 1, wherein the alkoxylated primary alkylmonoamine is a secondary alkylamine containing 11 carbon amine and an average of 2 ethylene oxide groups in the molecule, the monobasic alkanoic acid is n-octanoic, the dibasic alkanoic acid is azelaic acid and the molar ratio of alkoxylated amine to monobasic alkanoic acid to dibasic alkanoic acid is 2.4/2/1.

6. The lubricant product of claim 1, wherein the alkoxylated primary alkylmonoamine is a secondary alkylamine containing 11 carbon atoms and an average of 2 ethylene oxide groups in the molecule, the monobasic alkanoic acid is n-nonanoic acid, the dibasic alkanoic acid is sebacic and the molar ratio of alkoxylated amine to monobasic alkanoic acid to dibasic alkanoic acid is 2.4/2/1.

7. The lubricant product of claim 1 wherein the alkoxylated primary alkylmonoamine is a secondary alkylamine containing 10 to 14 carbon atoms and an average of 2 ethylene oxide groups in the molecule, the monobasic aklanoic acid is n-nonanoic acid, the dibasic alkanoic acid is adipic acid and the molar ratio of alkoxylated amine to monobasic alkanoic acid to dibasic alkanoic acid is 2.4/2/1.

8. The lubricant product of claim 1 wherein the alkoxylated primary alkylmonoamine is a secondary alkylamine containing 11 carbon atoms and an average of 2 ethylene oxide groups in the molecule, the monobasic alkanoic acid is n-nonanoic acid, the dibasic alkanoic acid is adipic acid and the molar ratio of alkoxylated amine to monobasic alkanoic acid to dibasic alkanoic acid is 2.4/2.1.

9. The lubricant product of claim 1, wherein the alkoxylated primary alkylmonoamine is a secondary alkylamine containing 11 carbon amine and an average of 2 ethylene oxide groups in the molecule, the monobasic alkanoic acid is n-nonanoic, the dibasic alkanoic acid is succinic acid and the molar ratio of alkoxylated amine to monobasic alkanoic acid to dibasic alkanoic acid is 2.4/2/1.

10. The lubricant product of claim 1 wherein the alkoxylated primary alkylmonoamine is a secondary alkylamine containing 11 carbon atoms and an average of 2 ethylene oxide groups in the molecule, the monobasic alkanoic acid is n-nonanoic acid, the dibasic alkanoic acid is azelaic acid and the molar ratio of alkoxylated amine to monobasic alkanoic acid to dibasic alkanoic acid is 1.6/0.66/1.

11. The lubricant product of claim 1 wherein the alkoxylated primary alkylmonoamine is a secondary alkylamine containing 11 carbon atoms and an average of 2 ethylene oxide groups in the molecule, the monobasic alkanoic acid is n-nonanoic acid, the dibasic alkanoic acid is azelaic acid and the molar ratio of alkoxylated amine to monobasic alkanoic acid to dibasic alkanoic acid is 1.4/0.3/1.

12. The lubricant product of claim 1 wherein the alkoxylated primary alkylmonoamine is a secondary alkylamine containing 11 carbon atoms and an average of 2 ethylene oxide groups in the molecule, the monobasic alkanoic acid is n-nonanoic acid, the dibasic alkanoic acid is azelaic acid to dibasic alkanoic acid is 1.0/1.45/0.11.

13. The lubricant product of claim 1, wherein the alkoxylated primary alkylmonoamine is a primary alkylamine containing 12 carbon amine and an average of 2 ethylene oxide groups in the molecule, the monobasic alkanoic acid is n-octanoic, the dibasic alkanoic acid is azelaic acid and the molar ratio of alkoxylated amine to monobasic alkanoic acid to dibasic alkanoic acid is 2.4/2/1.

14. The lubricant product of claim 1 wherein the alkoxylated primary alkylmonoamine is a secondary alkylamine containing 12 carbon atoms and an average of 15 ethylene oxide groups in the molecule, the monobasic alkanoic acid is n-nonanoic acid, the dibasic alkanoic acid is azelaic acid and the molar ratio of alkoxylated amine to monobasic alkanoic acid to dibasic alkanoic acid is 2/1/1.

15. The lubricant product of claim 1 wherein the alkoxylated primary alkylmonoamine is a primary alkylamine containing 12 carbon atoms and an average of 15 ethylene oxide groups in the molecule, the monobasic alkanoic acid is n-nonanoic acid, the dibasic alkanoic acid is azelaic acid and the molar ratio of the alkoxylated amine to monobasic alkanoic acid to dibasic alkanoic acid is 2.4/2/1.

* * * * *